US006398068B1

(12) United States Patent
Gehéniau

(10) Patent No.: US 6,398,068 B1
(45) **Date of Patent: *Jun. 4, 2002**

(54) CONTAINER HAVING LATERAL SUPPORTING HANDLES

(75) Inventor: Laurens Gehéniau, Schilde (BE)

(73) Assignee: QCC B.V.B.A., Schilde (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/249,991

(22) Filed: Feb. 13, 1999

(30) Foreign Application Priority Data

Feb. 13, 1998 (BE) ..... 09800110

(51) Int. Cl.[7] ..... B65D 21/00

(52) U.S. Cl. ..... 220/840; 206/504; 211/126.1; 220/23.4

(58) Field of Search ..... 220/574, 840, 220/4.21, 4.22, 4.23, 4.24, 23.4, 23.83, 556, 836, 839, 23.2, 23.6, 23.8, 23.86, 810, 833, 834, 835, 841, 1.5, 575; 206/558, 557, 504, 223, 541, 549, 555, 564; 211/7, 85.4, 41.1, 41.2, 41.11, 71.01, 84, 85.17, 126.1, 85.29, 134, 153

(56) References Cited

U.S. PATENT DOCUMENTS

| | | | | | |
|---|---|---|---|---|---|
| 444,042 | A | * | 6/1891 | Brock | 52/578 |
| 3,365,094 | A | * | 1/1968 | Palson | 220/840 |
| 3,612,335 | A | | 10/1971 | Schurman | |
| 3,811,595 | A | * | 5/1974 | Eckdahl et al. | 220/23.4 |
| 4,005,800 | A | * | 2/1977 | Schurman | 220/840 X |
| 4,013,214 | A | * | 3/1977 | Hansen et al. | 220/840 X |
| 4,029,234 | A | * | 6/1977 | Johnson, Jr. et al. | 220/840 |
| 4,081,101 | A | * | 3/1978 | West | 220/23.4 |
| 4,189,196 | A | | 2/1980 | Baker | |
| 4,216,862 | A | | 8/1980 | Daenen | |
| RE30,962 | E | * | 6/1982 | Bridges | 206/558 X |
| 4,560,859 | A | | 12/1985 | Brennan | |
| 4,615,464 | A | * | 10/1986 | Byrns | 220/4.23 |
| 4,653,818 | A | | 3/1987 | Debruyn | |
| 4,807,416 | A | * | 2/1989 | Parasin | 52/592.4 |
| 4,886,239 | A | * | 12/1989 | Stimmel | 220/23.4 |
| 5,022,516 | A | * | 6/1991 | Urban et al. | 220/840 X |
| 5,366,104 | A | * | 11/1994 | Armstrong | 220/4.23 X |
| 5,897,011 | A | * | 4/1999 | Brilliant et al. | 220/4.23 |
| 5,938,068 | A | * | 8/1999 | Atkins et al. | 220/4.23 X |

FOREIGN PATENT DOCUMENTS

| | | | | |
|---|---|---|---|---|
| DE | 3217328 | | 11/1983 | |
| DE | 3506645 | | 6/1986 | |
| DE | 3924138 | * | 1/1991 | 220/23.4 |
| DE | 9200424 | | 3/1992 | |
| JP | 08121919 | | 5/1996 | |

OTHER PUBLICATIONS

EPO Search Report.

* cited by examiner

*Primary Examiner*—Nathan J. Newhouse
*Assistant Examiner*—Joseph C. Merek
(74) *Attorney, Agent, or Firm*—John A. Merecki; Hoffman, Warnick & D'Alessandro LLC

(57) ABSTRACT

A container (10) has a tray-like bottom (11) and a cover (12). The bottom (11) has two protrusions or supporting handles (13, 14), suitable to hang the bottom on two parallel guides, located in a horizontal plane. The container has a nose or hook at its front side, for coupling another container, placed in front of it. This container (10) may be used to supply meals for passengers by using a trolley during passenger transport and avoids the necessity of a serving tray, on which the container is placed.

19 Claims, 2 Drawing Sheets

CONTAINER HAVING LATERAL SUPPORTING HANDLES

FIELD OF THE INVENTION

The present invention relates to a container having lateral supporting handles. Such a container is specifically suitable for supplying meals during flights, train and bus journeys.

BACKGROUND OF THE INVENTION

U.S. Pat. No. 4,648,511 describes a container for tableware and food, for serving meals on board of an aeroplane. The bottom and the cover of the container are connected to each other by a fixed hinge at the backside. The container has at its front side an opening for putting in and taking out dishes with food from the closed, optionally stacked, container. The upper edge of the four upwardly sloping walls of the bottom of the container is provided with a downwardly bent edge, for fitting in the stepped walls of the cover of the container.

A container as described in the above-mentioned patent, is placed on a serving tray on board of an aeroplane. A large number of those serving trays, on which each time a container is placed, is stored in a service carrier, also called "trolley", and is carried to the passengers during the journey. Each passenger receives a serving tray with a container, which contains the meal. The drawback of this combination of a serving tray and a container is that each passenger must be given two objects for lunch, which can move relatively to each other, by offering or accepting.

Alternatively, the food is placed directly on the serving tray and the serving trays are brought in the trolley to the passengers. The drawback of the latter method is that during sudden turbulence of the atmosphere and movements of the aeroplane or other vehicle, the food can slip off the serving tray.

OBJECT OF THE INVENTION

It is an object of this invention to provide a multifunctional lunch box for catering, as a container that may be carried efficiently to the passenger without the use of a serving tray.

Specific objects of the invention are that the lunch box is reusable, recyclable, may be closed and stacked.

Further specific objects of the invention are that the lunch box may be provided with an insert having several freely locatable recesses for tableware and food.

Another object of the invention is that at the inner- or outer side of the lunch box or at both sides advertising is possible.

Still another object is that several containers stacked one behind the other may be easily pushed in and pulled out of a rack, without the need to stretch the arm too much.

SUMMARY OF THE INVENTION

The above mentioned objects are realised by a container having the specific features defined in claim 1. Specific features for preferred embodiments of the invention are set out in the dependent claims.

According to the invention, the bottom of the container is provided with multifunctional supporting arms or supporting handles. These supporting handles may be used for handling the container. By giving them the correct form and size, the containers may be placed or pushed in almost all trolleys, or fixed dispensers, such as food automates, such that the use of serving trays is superfluous. The supporting handles 13, 14 may run completely parallel with the bottom side of the bottom wall 21 of the bottom 11. In a preferred embodiment, the supporting handles 13, 14 are bent or wavy.

Due to specific hinges in a preferred embodiment, the container may be opened according to various positions.

By a specific choice of the hinges, the container may be easily assembled and disassembled, i.e. by dismounting the cover from the bottom. This way, it is possible to provide the cover of the container with a colour that is different from that of the bottom. One or both parts may be made more or less transparent. The disassembled parts may be cleaned separately in a dishwasher. The bottom, as well as the cover may be reused a number of times. This number may be different for the bottom and the cover.

The inner side of the bottom has substantially the form of a cuboid or a rectangular parallelepiped. As such, the bottom may be freely filled with a suitable shrink form or vacuum form having recesses or holes for food and tableware. By means of inserts made of cardboard, paper or plastic, the articles may be secured in the container, thereby avoiding shifting or mixing them.

Specific embodiments allow advertising by the container: by application of insert sheets, stickers, prints or protrusions in the material of the container for logos or texts.

The container may be manufactured by several materials. In a preferred embodiment, the container resists a temperature of 100° C. Each part may—possibly locally—be provided with a specific texture. The structure may vary from very smooth to very rough or uneven. On places for stickers, the texture may be limited to a value of maximum 0.02 mm, to avoid jeopardising the fixture of the sticker on the surface. The texture may positively influence the look of the container, or accentuate advertising on insert sheets. Moreover, the texture may positively influence resistance against scratches.

In a preferred embodiment, the cover and the bottom are provided by a closure, such that opening and closing of the container may be easily done by hand. Most preferred is a snap, click- or snip closure.

In a specific embodiment, a raised edge at the bottom side of the bottom wall of the bottom provides a restricted contact area of the bottom with the surface on which the container is placed (temporarily). The raised edge also improves the ability for stacking the container. It is advantageous to provide a recess or hole in the upper side of the cover, which is compatible with the raised edge of the bottom, such that about twenty containers may be stacked vertically without any problem.

More advantageous results and embodiments of this invention will become clear from the following description and figures.

Figure 2:
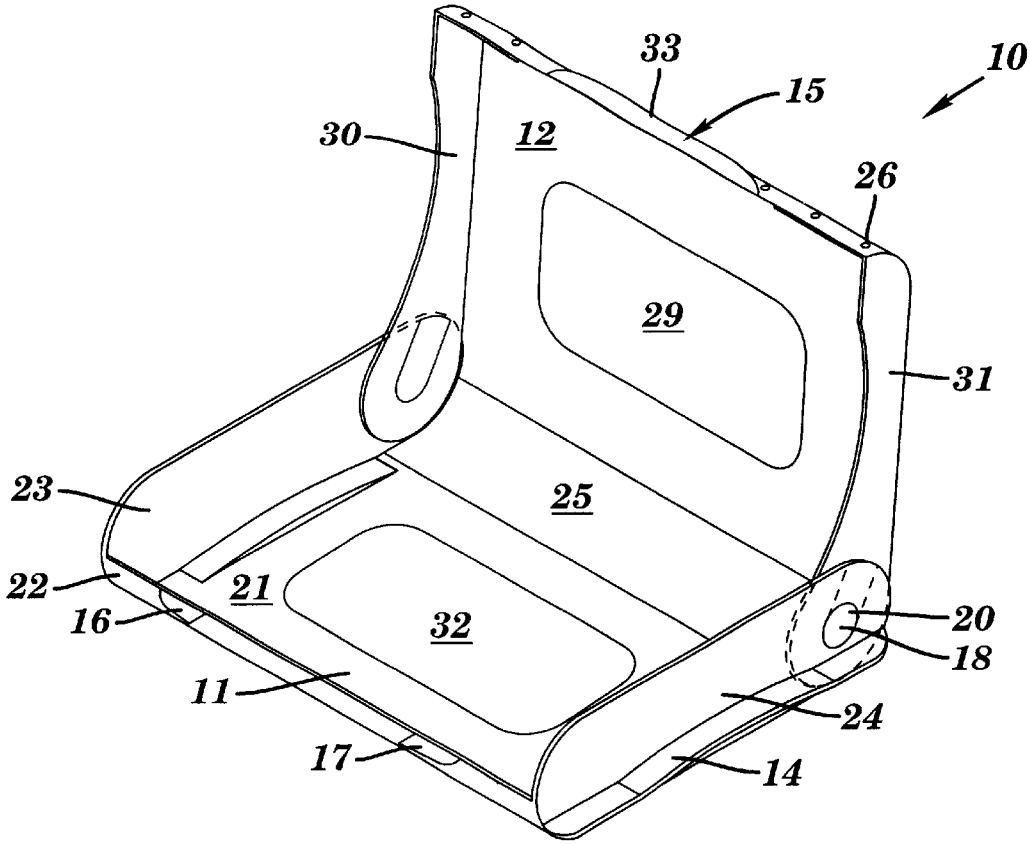
FIG. 2 shows a perspective view of a container according to the invention in an open position.

In the drawings, one single reference sign is given to an identical or analogous element.

DETAILED DESCRIPTION OF THE INVENTION

Figure 1:
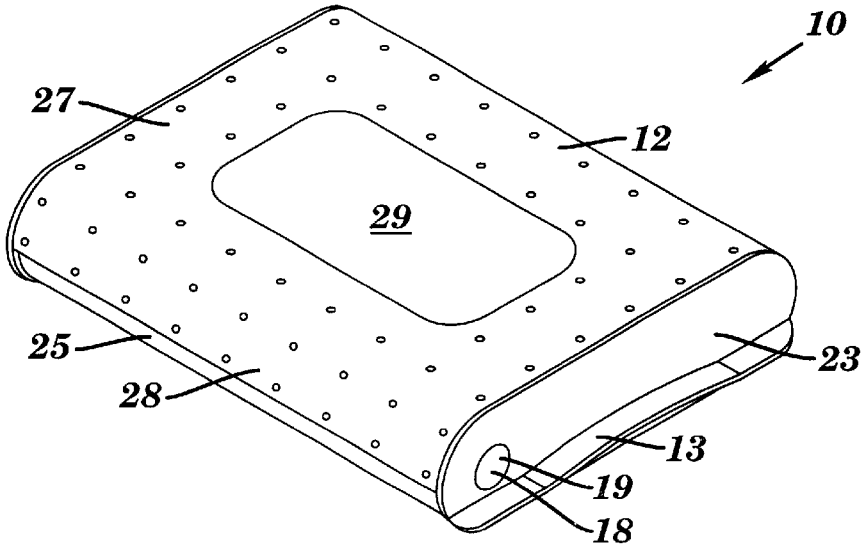
FIG. 1 shows a perspective view of a container according to the invention in a closed position.
Figure 3:
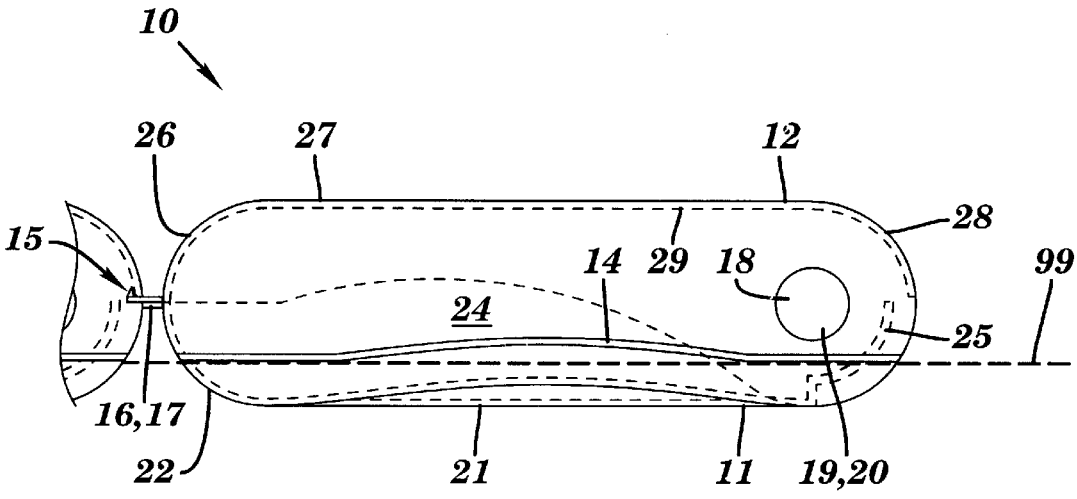
FIG. 3 shows a side view from right of the container according to the invention in a closed position.
Figure 4:
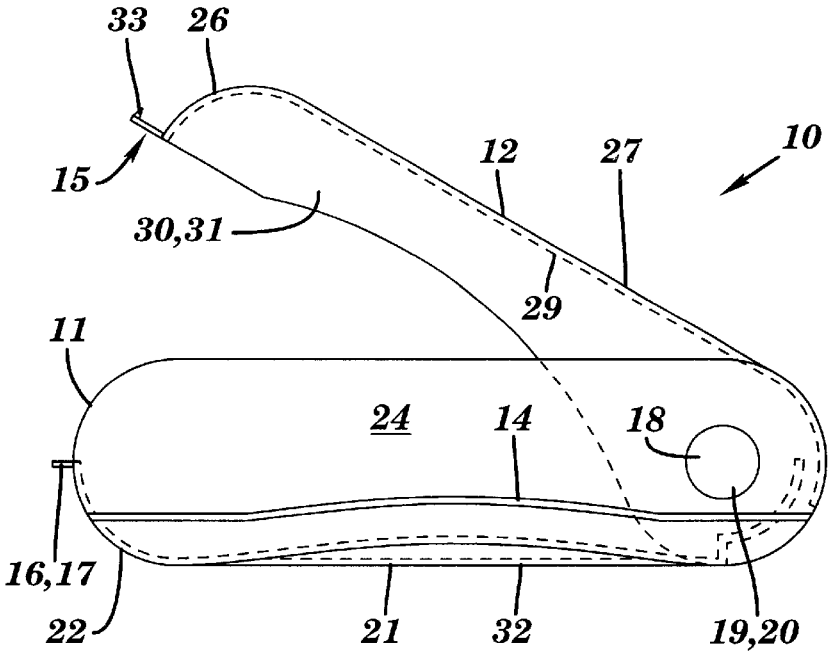
FIG. 4 shows a side view from right of the container according to the invention in an open position.
Figure 5:
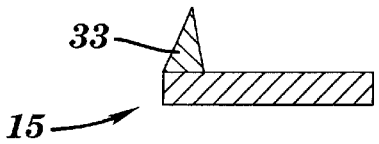
FIG. 5 is an enlarged cross-sectional view of the triangular nose of the container according to the invention.

FIGS. 1, 2, 3 and 4 show a container 10 or box according to the invention. For clarity, the terms referring to orientation, such as "standing", "hanging" etc. shall mean the orientation of the container 10 as shown in FIG. 1 and placed on a horizontal plane. The container mainly consists of a bottom 11 and optionally of a cover 12. The latter has the advantage that the tableware and all food are closed in the container and may, if necessary, be simply secured. The bottom 11 has a substantially planar bottom wall 21. Because the bottom wall 21 is substantially planar, an insert having a planar bottom side may be inserted. On the bottom wall 21, crossing ribs may be provided, having a maximum height of not more than 5 mm or even only 2 mm. These ribs may be provided internally, i.e. on top of the bottom wall 21, or externally, i.e. below the bottom wall 21. In a preferred embodiment, the bottom wall 21 fits between two parallel planes, having a relative distance of 5 mm or even 2 mm. The bottom 11 has preferably also four upstanding walls: one front wall 22, one left side wall 23, one right side wall 24, and one back wall 25. If the bottom is placed horizontally, the side walls 23, 24 are substantially vertical. They deviate from a vertical plane by not more than +20° or −20°. This deviation may also be maximally −10° to +10° or even −5° to +5°. The four upstanding walls form a closed periphery, and they constitute together with the bottom wall the bottom 11, having the form of a substantially rectangular tray. According to the invention, the side walls 23, 24 of the bottom 11 are provided with a left supporting handle 13 and a right supporting handle 14. The function of these supporting handles on the one hand is to manipulate the bottom and on the other hand to hang the bottom on two parallel and horizontal guides (a general representation of one of the guides (e.g. part of a stacking rack) is represented by dashed line 99 in FIG. 3) of a horizontally placed trolley or dispenser. The left supporting handle herewith rests on a left guide or bar, the right supporting handle rests on a right guide or bar. Normally, the upper side of both guides is situated in one horizontal plane and the guides are parallel to each other. When the trolley is in a sloping position during the journey, then the plane formed by the parallel guides is also not horizontal. In case the supporting handles are made wavy, it is advantageous that each supporting handle rests on at least two points or line contacts on a horizontal guide in the trolley. This means that for a horizontally placed bottom 11, the generating lines for each supporting handle 13, 14 are substantially orthogonal to the side wall 23, 24, but that these generating lines, running from the front towards the back, follow a wavy curve. If there are more waves, each supporting handle 13, 14 may have three or more different supporting points with the guide. A supporting point may thus be a line contact or a point contact. Preferably, these generating lines are also horizontal. Substantially orthogonal means that a declination of −20° to +20° or −10° to +10° or −5° to +5° is allowed. It is also advantageous that the width of the supporting handles 13, 14 is reduced at the front side or at the backside of the bottom 11 or at both sides. This seriously simplifies introduction of the container on the guides in the trolley. A small lateral position error caused by the crew, is corrected automatically by introduction of the container. In a preferred embodiment, for a horizontally placed bottom 11, the upper edges of the side walls 23 and 24 are positioned higher than the upper edges of the front wall 22 and the back wall 25. The lower front wall improves the ergonomics of the container by an improved accessibility towards the contents of the container. The higher side walls enable the fixture of the supporting handles 13 and 14 on them and moreover to position the hinge points for the cover above the supporting handles, as described below. It is advantageous to locate the supporting handles 13 and 14 on the lower half or the lower third of the side walls 23 and 24, such that the side walls are deformed minimally, i.e. bent inside, by lifting or hanging the container 10 at the supporting handles 13, 14.

The cover 12 has in the first place a front side 26, an upper side 27 and a backside 28, which preferentially are smoothly arranged. According to an advantageous embodiment, the front side 26 and the backside 28 are also connected to each other by a left side flange 30 and a right side flange 31. The side flanges 30, 31 are preferably also connected to the upper side 27. It is preferred that the cover does not rest on the supporting handles 13 and 14, but on at least one supporting point, for example on hinge points or on the upper edge of the upstanding edges of the bottom 11. In that case, the supporting handles make exclusively contact with the bottom 11 via the side walls 23, 24 and the bottom 11 carries the cover 12 via other supporting points.

The upper side 27 of the cover 12 may be provided with a recessed portion or recess 29. As said before, the recess 29 in the upper side of the cover may co-operate with an upstanding edge 32 at the lower side of the bottom wall 21 of the bottom 11, to stack the containers 10 vertically. The upstanding wall 32 is conceived such that the bottom—when the upstanding edge 32 makes contact with a horizontal surface—is also horizontal. The side walls of the bottom 11 may have a wavy form, such that the bottom has not completely the form of a cuboid.

The surface of the recessed portion or recess 29 may be slightly textured, such that in the recess a sticker with advertising may be placed. Alternatively, the whole upper portion 27 of the cover 12 or a portion of it, may be printed. Also in this case, the texture is preferably 0.02 mm or finer. This texture enables printing and sticking stickers.

If the upper side 27 of the cover 12 has not or partially been provided with advertising at the outer side, then it is advantageous to make, at least the portion without advertising of the cover, more or less transparent. The inner side of the cover may be provided with clamps, hooks or two parallelly running edges, such that an insert sheet may be fixed at the inner side of the cover 12. The means for fixing the insert sheet and the length of the sheet may be selected such that the sheet follows as close as possible the inner surface of the cover, such that a clear image is visible for the observer looking on the top side of the transparent cover 12. The cover 12 may then have at least locally the transparency of milky glass. This may be achieved by manufacturing the cover from polypropylene. When the passenger opens the cover 12, he sees the backside of the insert sheet, on which advertising may also appear.

It is also advantageous to provide the upper side, i.e. the outer side, of the upper portion 27 of the cover 12 with protrusions having the form of a halve sphere, having a thickness between 1 mm and 5 mm. These protrusions may be located on the corner points of a square or rectangular grid. The length of the smallest rectangle in such grid is between 20 mm and 40 mm, preferably each length is 30 mm. These protrusions improve the resistance against scratches of the upper side 27, whenever the containers are stacked on top of each other. It is then also advantageous to provide in the lower side, i.e. the outer side, of the lower wall 21 of the bottom 11 a slit-like recess or cut-out, in which fit several half spherical protrusions, from a container placed below. The slit has preferably a length corresponding to the distance between the most distant protrusions on one grid line, such that the outer edges of the slit correspond to the first and last protrusion.

The bottom 11 is preferably made of one piece. In addition, the cover 12 is preferably made in one piece. The cover 12 may rest freely on the upstanding walls of the bottom 11, or the cover 12 may be hingedly connected to the bottom 11. A possible embodiment for a hinge 18 between bottom 11 and cover 12 is a linear hinge, formed by a longitudinal and flexible synthetic element, which forms an integral part of the back side of the bottom 11 and of the back side of the cover 12. In a more preferred embodiment, the hinge is formed by a left supporting point 19 and a right supporting point 20. The left supporting point 19 consists of a substantially cylindrical opening or recess at the back in the left side wall 23 of the bottom 11 and a corresponding, substantially cylindrical, protrusion in the left side flange 30 of the cover 12. The right supporting point 20 is formed analogously. The cylindrical protrusion in the left side flange 30 is preferably oriented to the left, i.e. to the outer side of the container, whereas the right protrusion in the right side flange 31 is preferably oriented to the right. By pressing gently the left side flange 30 and the right side flange 31 of the cover 12 in this embodiment towards each other, the cover 12 may be disassembled from the bottom 11 or assembled again. In the assembled situation, both side flanges 30 and 31 are located between the left and right side wall 23, 24 of the bottom. This embodiment has the advantage that from the outer side the cylindrical protrusions may be pressed to assemble or disassemble the cover. According to a preferred embodiment, around each cylindrical protrusion on the side flanges 30, 31, a U-shaped cut-out is provided. By this option, each cylindrical protrusion is connected only by the upper portion of the U with the other portion of the side flange. This feature increases the flexibility of the cylindrical protrusions, such that those may be pressed using a small force to disassemble the cover from the snap closure. The company that fills the containers, may place the bottoms on a conveyor belt, fill them, and finally provide them with a cover.

In closed position, the cover 12 is hanging at its backside in the cylindrical recesses and rests at its front side on the front wall of the bottom 22.

On the left side flange 30 and the right side flange 31 in the cover, half spherical protrusions may be provided, which snap in circular recesses in the left side wall 23 and the right side wall 24 of the bottom 11. The protrusions and recesses are located on equal distances on a circular arc, such that various snapped rotational positions of the bottom 11 and the cover 12 with respect to each other are possible, and in each snapped position a number of protrusions is snapped in corresponding recesses.

In normal operation, the cover 12 rotates with respect to the bottom 11 around the imaginary axis that connects the two supporting points 19 and 20. When the cover 12 of the container 10 is opened, then according to a preferred embodiment the backside 28 of the cover 12 is moving behind the backside 25 of the bottom. This way, the cover may rotate freely, even if within the bottom a closely fitting shrink form is mounted.

In an alternative embodiment, the hinge is formed by two elongate elements, forming a gap between them. The gap may be advantageously used to couple a nose or hook of a second container located behind the hinge, as is described below. According to a preferred embodiment, the bottom, hinge and cover are made of one type of material, and are more preferably forming one integral part. In this case, it is also preferred to provide flanges on the side walls, to disable automatic rotation of the cover with respect to the bottom. This may be realised by the friction of flanges, where a flange of the bottom is in contact with a flange of the cover.

When the bottom 11 is filled, first a suitable shrink form may be placed on the lower wall 21 of the bottom. This shrink form has a plurality of recesses, purposively partitioning the space in the bottom 11. Each recess or compartment may be used to store food, cutlery and crockery or more generally tableware, nicely separated. The shrink form may be made from synthetic material, having recesses or compartments for food and tableware. The shrink form may also be replaced by a cardboard sheet, to be placed horizontally, and having circular recesses or cut-outs having another suitable form and having two upstanding edges, such that the cardboard sheet may be installed partly raised and parallel to the bottom wall 21 of the bottom 11, resting on the upstanding side edges.

If the cover 12 is hingedly mounted on the bottom 11, then the front side of the cover 12 may be provided with a handle 15 to hingedly open and close the container manually. The closed position may be secured by a closure system 16, 17 between the front wall 22 of the bottom 11 and the front side 26 of the cover 12. The closure mechanism 16, 17 and the handle 15 preferably grip each other in a resilient way, such that a closed container remains in closed position, without manual operation of a force to open the container.

The handle 15 at the front side is, according to a preferred embodiment, provided with a nose 33 or hook, having the following function. When two closed containers are placed one after the other, and when the containers are pressed against each other, the lower portion of the backside 28 of the cover 12 of the container at the front side will hook at the upper side of the nose 33 of the container at the back side. This may be realised by making that the lower edge of the back wall of the cover is positioned slightly higher than the upper portion of the handle, on which the nose is located. Slightly higher may be e.g. between 0.1 mm and 5 mm. The function of this is that, when the front container is shifted towards the back container, the back side of the front container is lifted by the nose and that back side latches on the nose. This way, it is almost impossible to move the front container along the guides in the trolley towards the front side, without moving also the back container towards the front side. Therefore, the nose may have a triangular cross section. This has the important advantage that the crew, when containers are stacked one behind the other, never has to reach too far to take the most distant container. As soon as the container at the front side is lifted, the backside of it loses contact with the nose of the back container. Another advantage of latching the back side over the nose located on the cover is that the front container is resting on the cover of the back container, thereby avoiding that the back container opens by itself.

During the journey, the containers will be carried separately in the trolley, by the internal lateral guides in the trolleys and if they are placed one behind the other, they are preferably connected with each other via the back side of the cover and the nose 33 in the handle 15.

According to a preferred embodiment, suitable to conform the KSSU standard or adaptable to the Atlas standard defined in civil aviation, the size of the container 10, in closed position and placed on a horizontal plane is as follows: height or thickness, including the cover 12: 58 mm.

The highest point of the bottom 11 with upstanding walls is at 57 mm. The height of the lateral supporting handles 13, 14, with respect to the horizontal plane on which the container is placed, is 17 mm. The total width of the container 10, including the lateral supporting handles 13, 14 is 277 mm. Each supporting handle 13, 14 has preferably a width of 10 mm, such that the width of the container 10 without supporting handles is 257 mm. The width of a supporting handle, i.e. the largest distance to the side wall on which the supporting handle is fixed, is preferably 3 mm or more. A narrower supporting handle is less suitable to handle and increases the risk that the container slips laterally from the guides. It is even more preferred that the width is at least 5 mm or even 10 mm. The length of the container 10 in closed position, measured from the farthest front point to the farthest back point is 216 mm. The width of the handle 15 in front of the cover 12 is about 165 mm, each locking mechanism 16, 17 has a width of about 25 mm. The length of the handle 15 at the front side of the cover 12 is 10 mm. A container having the above mentioned sizes may be used in almost all service trolleys in civil aviation.

A container according to this invention may be made preferably completely from synthetic material, for example by an injection process. Polypropylene, filled with chalk or not, is a very suitable synthetic material. In addition, polystyrene is suitable for the production of such a container. The production of a container according to the invention may be done by construction of a first injection mould for the bottom with two supporting handles and a second injection mould for the cover. The two injection moulds are conceived such that the injected cover may be placed on top of the injected bottom. The bottom with supporting handles is made in the first injection mould, the cover is manufactured in the second injection mould. When use is made of an elongate hinge, the bottom and cover may be made in one production pass, from one sheet of plastic, having a thickness between 2 mm and 0.1 mm, e.g. of 0.6 mm. The plastic material is softened and forced by vacuum in a form, thereby forming the bottom, the hinge and cover.

After this detailed description of preferred embodiments for this invention, it will be clear for the man skilled in the art that various modifications may be made, without departing form the scope of the invention, as defined in the claims below.

PART LIST

10: container
11: bottom
12: cover
13: left supporting handle
14: right supporting handle
15: front handle
16: left closure mechanism
17: right closure mechanism
18: hinge
19: left supporting point
20: right supporting point
21: bottom wall of the bottom
22: front wall of the bottom
23: left side wall of the bottom
24: right side wall of the bottom
25: back wall of the bottom
26: front wall of the cover
27: top wall of the cover
28: back wall of the cover
29: recess in top wall of the cover
30: left side flange in cover
31: right side flange in cover
32: upward edge at bottom side of bottom wall of bottom
33: nose in handle

What is claimed is:

1. A container comprising:

a bottom having two side walls;

at least one supporting handle on each side wall of the bottom for placing the container on two parallel bars situated in one plane;

a cover, coupled to said bottom, said cover having a back wall and a front wall;

wherein said container further includes:

a nose having a triangular cross-section coupled to said front wall of the cover for latching the back wall of a second, identical container, located on said two parallel bars and before the nose, when both said container and said second container are closed, wherein the back wall of said second container loses contact with the nose of said container when said second container is lifted.

2. The container according to claim 1, wherein each supporting handle protrudes at least 3 mm or at least 5 mm or at least 10 mm from the side wall, on which it is fixed.

3. The container according to claim 1, wherein each supporting handle forms a substantially right angle with the side wall on which it is fixed.

4. The container according to claim 1, further comprising a hinge for hingedly coupling the cover with the bottom.

5. The container according to claim 4, wherein the hinge is formed by substantially cylindrical recesses in the bottom and substantially cylindrical protrusions in the cover.

6. The container according to claim 4, wherein the bottom has a back wall, and wherein the hinge is formed by at least one elongate and flexible element forming an integral part with the back wall of the bottom and with the back wall of the cover.

7. The container according to claim 1, wherein the cover is provided with a handle for opening and closing the container.

8. The container according to claim 1, wherein the cover provided with recess or a hole in the upper side.

9. An apparatus comprising:

a container including a bottom having two side walls, at least one supporting handle on each side wall of the bottom, a cover, coupled to said bottom, said cover having a back wall, a front wall, and a nose having a triangular cross-section coupled to said front wall of the cover for latching the back wall of a second, identical container, located before the nose, when both said container and said second container are closed, wherein the back wall of said second container loses contact with the nose of said container when said second container is lifted; and a stacking rack having parallel guides, two by two located in one plane, for supporting the supporting handles of said container and said second container.

10. The container according to claim 1, wherein the container is used for storing food.

11. The apparatus according to claim 9, wherein each supporting handle of the container protrudes at least about 3 mm from the side wall on which it is fixed.

12. The apparatus according to claim 9, wherein each supporting handle of the container forms a substantially right angle with the side wall on which it is fixed.

13. The apparatus according to claim 9, wherein the container further includes a hinge for hingedly coupling the cover with the bottom.

14. The apparatus according to claim 13, wherein the hinge is formed by substantially cylindrical recesses in the bottom and substantially cylindrical protrusions in the cover.

15. The apparatus according to claim 13, wherein the bottom has a back wall, and wherein the hinge is formed by at least one elongate and flexible element forming an integral part with the back wall of the bottom and with the back wall of the cover.

16. The apparatus according to claim 9, wherein the cover is provided with a handle for opening and closing the container.

17. The apparatus according to claim 9, wherein the cover is provided with a recess or a hole in the upper side.

18. The apparatus according to claim 9, wherein the back wall of the cover of the second container in front of said first container has a lower portion for hooking at an upper side of the nose of said first container.

19. A combination of at least two containers comprising a first container and a second, identical container, said second container located in front of said first container, wherein:

said first container includes a bottom having two side walls, at least one supporting handle on each side wall for placing the first container on two parallel bars situated in one plane, a cover, coupled to said bottom, having a back wall and a front wall, and a nose having a triangular cross-section coupled to said front wall;

said second container includes a bottom having two side walls, at least one supporting handle on each side wall of the second container for placing the second container on two parallel bars situated in one plane, a cover, coupled to said bottom of said second container, having a back wall and a front wall, and a nose having a triangular cross-section coupled to said front wall; and wherein the back wall of the cover of the second container in front of said first container has a lower portion for hooking at an upper side of the nose of said first container, when both said container and said second container are closed, wherein the back wall of said second container loses contact with the nose of said container when said second container is lifted.

* * * * *